United States Patent [19]

Johansson

[11] Patent Number: 4,964,954

[45] Date of Patent: Oct. 23, 1990

[54] PROCESS FOR THE PRODUCTION OF PAPER

[75] Inventor: Hans Johansson, Kungäly, Sweden

[73] Assignee: Eka Nobel AB, Surte, Sweden

[21] Appl. No.: 267,121

[22] PCT Filed: Feb. 16, 1988

[86] PCT No.: PCT/SE88/00063

§ 371 Date: Oct. 26, 1988

§ 102(e) Date: Oct. 26, 1988

[87] PCT Pub. No.: WO88/06659

PCT Pub. Date: Sep. 7, 1988

[30] Foreign Application Priority Data

Mar. 3, 1987 [SE] Sweden ..... 8700891
Mar. 25, 1987 [SE] Sweden ..... 8701252

[51] Int. Cl.[5] ..... D21H 17/45; D21H 17/74

[52] U.S. Cl. ..... 162/164.6; 162/168.3; 162/181.2; 162/181.6

[58] Field of Search ..... 162/168.2, 168.3, 164.6, 162/181.6, 181.8, 181.5, 181.4, 181.2, 181.3

[56] References Cited

U.S. PATENT DOCUMENTS

| | | | |
|---|---|---|---|
| 3,520,824 | 7/1970 | Plank et al. | 252/313 |
| 3,834,921 | 9/1974 | Mays et al. | 106/288 B |
| 4,294,885 | 10/1981 | Sunden | 428/404 |
| 4,309,247 | 1/1982 | Hou et al. | 162/149 |
| 4,388,150 | 6/1983 | Sunden et al. | 162/175 |
| 4,578,150 | 3/1986 | Hou | 162/164 |
| 4,643,801 | 2/1987 | Johnson | 162/164 |
| 4,795,531 | 1/1989 | Sofia et al. | 162/168.3 |

FOREIGN PATENT DOCUMENTS

| | | |
|---|---|---|
| 0080986 | 11/1982 | European Pat. Off. . |
| 0041056 | 8/1984 | European Pat. Off. . |
| 0145686 | 11/1984 | European Pat. Off. . |
| 2015614 | 2/1979 | United Kingdom . |
| 8600100 | 1/1986 | World Int. Prop. O. . |
| 8605826 | 10/1986 | World Int. Prop. O. . |

OTHER PUBLICATIONS

Casey, *Pulp and Paper,* 3rd Ed. (1981), vol. III, pp. 1536, 1537.

Rowland, "The Colloidal Nature of Clay with Reference to Papermaking," *TAPPI,* Oct. 17, 1940, pp. 207–212.

*Primary Examiner*—Peter Chin

*Attorney, Agent, or Firm*—Burns, Doane, Swecker & Mathis

[57] ABSTRACT

A method for the production of paper by forming and dewatering a suspension of papermaking fibres on a wire. The formation and dewatering take place in the presence of a cationic polymeric synthetic retention agent, preferably a cationic polyacrylamide, an anionic inorganic colloid and a polyaluminum compound. The process which is carried out at a stock pH above 5 gives an improved dewatering and an improved retention of fine fibres and optional fillers.

10 Claims, No Drawings

PROCESS FOR THE PRODUCTION OF PAPER

The present invention relates to a process for the production of paper utilizing an improved retention- and dewatering system. More particularly the invention relates to the use of a combination of a cationic polymeric retention agent, an anionic inorganic colloid and polyaluminum compound as retention- and dewatering system in papermaking.

It is previously known to use combinations of cationic retention agents and inorganic colloids as retention and dewatering agents in the production of paper. The European patent application No. 0218674 discloses the use of polyacrylamide in combination with anionic silica sols as binders and retention agents. It is also previously known to use polymeric cationic retention agents in combination with polyaluminum compounds and this is disclosed in the British patent No. 2015614. The effect of the silica sol on for example cationic starch with regard to retention and dewatering of the fibre web is considerably better than the effect obtained by polyaluminum compounds and cationic starch. It is assumed that one of the reasons for this is that the inorganic anionic colloids have much stronger charges than the polyaluminum compounds which have a complex composition. It is assumed that the colloidal particles with their strong charges produce a cross-linking of the polymeric retention agents. It is further known from the U.S. Pat. No. 4,643,801 to use a combination of a cationic starch, an anionic silica sol and an anionic high molecular weight polymer, particularly an anionic polyacrylamide, as a binder in papermaking. The three component system according to the U.S. patent can be used with additional aluminum compounds, such as alum, sodium aluminate or polyhydroxyaluminum chloride.

According to the present invention it has been found that the retention- and dewatering effect in papermaking is improved if a polyaluminum compound is used in combination with an organic, synthetic, polymeric cationic retention agent and an anionic inorganic colloid. As the dewatering effect is increased the speed of the papermachine can be increased and, further, less water will have to be dried off in the drying section of the paper machine.

The present invention thus relates to a process for the production of paper by forming and dewatering a suspension of papermaking fibres, and optionall fillers, on a wire whereby the forming and dewatering take place at a pH above 5 and in the presence of an anionic inorganic colloid, a polyaluminum compound and a cationic, synthetic polymeric retention agent which is a cationic polyacrylamide or a polyethyleneimine.

The three components can be added to the fibre stock in arbitrary order. The best effect is obtained if the polyaluminum compound is added to the stock first, and then followed by addition of cationic retention agent and anionic inorganic colloid. A considerable improvement, in comparison with known technique, is obtained also when the anionic inorganic colloid is first added to the stock and the cationic polymer and the polyaluminum compound are added subsequently, in any order.

The cationic, synthetic polymeric retention agents used in the three-component system for papermaking according to the present invention are per se conventional cationic polyacrylamide and polyethyleneimine retention agents. The amount of the retention agent should be within the range of from 0.01 to 3 percent by weight, preferably within the range of from 0.03 to 2 percent by weight, based on dry fibres and optional fillers.

The anionic inorganic colloids which are used are also per se previously known for use in papermaking. As examples of such colloids can be mentioned colloidal montmorillonite and bentonite, titanyl sulphate sols, silica sols, aluminum modified silica sols or aluminum silicate sols. Silica based colloids are the preferred anionic inorganic colloids. The amount of anionic colloid should be within the range of from 0.005 to 2 percent by weight, preferably within the range of from 0.01 to 0.4 percent by weight, based on dry cellulose fibres and optional fillers.

A preferred system which is used in combination with a polyaluminum compound is a combination of cationic polyacrylamide and silica sol Silica sols as disclosed in the European patent No. 41056, which is hereby incorporated in this application by reference, are particularly preferred and especially alkali stabilized such sols. Another preferred system is a cationic polyacrylamide and an anionic, aluminum modified silica colloid as disclosed in the European patent application No. 0218674, which likewise is incorporated herein by reference.

Good results are obtained using colloidal silica in the form of an alkali stabilized sol which contains about 2 to 60 percent by weight of $SiO_2$, preferably about 4 to 30 percent by weight of $SiO_2$. The colloidal silica concentration in the sol is not critical. From a practical point of view it is anyhow suitable to dilute the sols to a concentration of from 0.05 to 5.0 percent by weight, before addition to the stock.

The colloidal silica in the sol should preferably have a specific surface of 50 to 1000 $m^2/g$ and more preferably of about 200 to 1000 $m^2/g$, and the best results have been obtained when the specific surface has been about 300 to 700 $m^2/g$. The silica sol is stabilized with alkali in a molar ratio of $SiO_2:M_2O$ of from 10:1 to 300:1, preferably 15:1 to 100:1 (M is an ion from the group Na, K, Li and $NH_4$). It has been established that the colloidal silica particles should have a size below 20 nm and preferably an average particle size of from about 10 down to about 1 nm (a colloidal silica particle with a specific surface of about 550 $g/m^2$ corresponds to an average particle size of about 5 nm).

Silica sols which fulfil the above given specifications are available commercially, e.g. from Du Pont & de Nemours Corporation and Eka Nobel AB.

As has been mentioned above very good results are obtained using anionic colloidal particles which have at least a surface layer of aluminum silicate or aluminum modified silica sol so that the surface groups of the particles contain silica and aluminum atoms in a ratio of from 9.5:0.5 to 7.5:2.5. Sols of this type also preferably have a specific surface of from 50 to 1000 $m^2/g$, or more preferably from 200 to 1000 $m^2/g$. As in the case of pure silica sols the best results have been observed at specific surfaces within the range of about 300 to 700 $m^2/g$.

The polyaluminum compounds which are used according to the present invention are also previously known for use in papermaking. They are termed basic and consist of polynuclear complexes. The polyaluminum compounds shall, in aqueous solution, contain at least 4 aluminum atoms per ion and preferably at least 10. The upper amount of aluminum atoms in the complexes are dependent on the composition of the aqueous phase and can vary, e.g. depending on the concentration and the pH. Normally the amount does not exceed 30. The molar ratio of aluminum to counter ion, with the exception of hydroxide ions, should be at least 0.4:1 and preferably at least 0.6:1.

As example of a suitable polyaluminum compound can be mentioned compounds with the net formula $$n[Al_2(OH)_mCl_{6-m}]$$

which have a basicity of from 30 to 90%, preferably 33 to 83%. (m=2 and m=5, respectively)

Basicity is defined as the number of OH-groups divided by the number of OH groups and chloride ions ×100, i.e. (m:6)×100.

The polyaluminum compound can also contain anions from sulphuric acid, phosphoric acid, polyphosphoric acid, chromic acid, citric acid or oxalic acid, whereby the ratio of aluminum to such anions should be within the range of from 0.015 to 0.4.

The most common type of polyaluminum compound has m=3, i.e. $Al_2(OH)_3Cl_3$ with a basicity of about 50%. As examples of commercially available compounds of this type can be mentioned Sachtoklar® (sulphate free) sold by Sachtleben GmbH, F.R. Germany, WAC (contains sulphate) sold by Atochem, France, and Ekoflock (contains sulphate) sold by Ekoflock AB, Sweden.

As another example of polyaluminum chlorides can be mentioned the highly basic polyaluminum chloride which is sold by Hoechst AG, F.R. Germany, under the name Locron and which has the net formula $[Al_2(OH)_5Cl.5H_2O]_x$ and which in aqueous solution gives the complex ion $$[Al_{13}O_4(OH)_{24}(H_2O)_{12}]^{7+}.$$

The amount of the polyaluminum compound can vary within wide limits. It has according to the invention been found that already very small amounts of polyaluminum compound, with regard to the amount of anionic inorganic colloid, give substantial improvements of the dewatering effect. Improvement is obtained at a weight ratio polyaluminum compound to inorganic colloid of 0.01:1. The upper limit is not critical. However, no improvements worth mentioning are obtained when the ratio of polyaluminum compound to inorganic colloid is greater than 3:1. The ratio is suitably within the range from 0.02:1 to 1.5:1, preferably from 0.05:1 to 0.7:1. The ratio refers to the weight ratio between the polyaluminum compound, calculated as $Al_2O_3$, and the inorganic colloid.

According to the invention it is important that the pH of the stock is kept above 5, and preferably from 6 to 9. This is suitably achieved by addition of for example sodium hydroxide. If an alkaline filler is used, such as chalk, the suitable pH is reached without or with smaller amounts of sodium hydroxide Other fillers than calcium carbonate can of course be used but care should be taken to keep the pH of the stock at the levels stated above.

At paper production according to the invention mineral fillers of conventional types can be used, e.g. kaolin, titanium dioxide, gypsum, chalk and talcum, can be present. The term "mineral filler" is herein used to include, besides these fillers, also wollastonite and glass fibres and also mineral low density fillers such as expanded perlite. The mineral filler is usually added in the form of a water slurry in conventional concentrations used for such fillers. Before the addition the filler can optionally be treated with components of the dewatering- and retention system according to the invention, e.g. by addition of the cationic retention agent and the polyaluminum compound, or, and preferably, of the inorganic anionic colloid, whereafter the remaining component is added to the stock.

The three component system of the present invention can be used in papermaking from different types of stocks of papermaking fibres, i.e. stocks containing at least 50 percent by weight of cellulosic fibres. The components can for example be used as additives to stocks from fibres from chemical pulp, such as sulphate and sulphite pulp, thermomechanical pulp, chemical thermomechanical pulp, refiner mechanical pulp or groundwood pulp, from as well hardwood as softwood. The system can of course also be used for pulps from recycled fibres.

The process according to the invention can be carried out in a known manner and with other known additions to the fibre stock, such as sizing agents etc.

The invention is further illustrated in the following examples, wherein parts and percent relate to parts by weight and percent by weight, unless otherwise stated.

EXAMPLE 1

In the following tests the dewatering has been evaluated with a "Canadian Freeness Tester", which is the usual method for characterizing the dewatering or drainage capability according to SCAN-C 21:65.

The stock system was composed of 100% groundwood pulp with a CSF (Canadian Standard Freeness) of 110 ml. The pH of the stock was 8. The chemical additions have been calculated in kg per ton dry stock system.

The anionic inorganic colloid was an aluminum modified 15% alkali stabilized silica sol from Eka Nobel AB. The surface of the colloidal particles was modified with 9% of Al atoms and the surface area of the particles was 500 $m^2/g$.

The cationic polymeric retention agent was a cationic polyacrylamide, of medium cationicity, sold by Allied Colloids under the name of Percol 292.

The polyaluminum compounds used in the tests were:

SACHTOKLAR® from Sachtleben GmbH, F.R. Germany, with an $Al_2O_3$ content of 10.0%.

WAC from Atochem, France, with an $Al_2O_3$ content of 10.0%

Ekoflock from Ekoflock AB, Sweden, with an $Al_2O_3$ content of 11.9%

The additions were made to 1 liter of diluted (about 0.3%) stock with intervals of 15 seconds under agitation (polyaluminum compound+cationic polyacrylamide+silica sol) and the flocculated stock was then passed to the freeness apparatus and measurements made 15 seconds after the last addition. The collected water is a measure of the dewatering effect and given as ml Canadian Standard Freeness (CSF).

The collected water was very clear after the addition of the three components and this shows that also a good retention effect of the fines material to the fibre flocks had been obtained according to the invention.

The results of the different tests with the aluminum compounds are shown in the table. The additions are calculated as kg $Al_2O_3$ per ton dry stock, kg $SiO_2$ per ton dry stock, and kg polyacrylamide per ton dry stock, respectively.

| Test No. | Polyaluminum compound kg/t WAC | Polyacrylamide kg/t | Colloid kg/t | CSF ml |
|---|---|---|---|---|
| 1 | — | — | — | 110 |
| 2 | — | 1 | — | 220 |
| 3 | — | 1.2 | — | 225 |
| 4 | — | 2 | — | 235 |
| 5 | — | 1 | 2.0 | 320 |
| 6 | — | 1.2 | 2.0 | 330 |
| 7 | — | 1.0 | 2.2 | 340 |
| 8 | — | 2 | 2 | 355 |
| 9 | 0.2 | — | — | 120 |
| 10 | 0.2 | 1 | — | 240 |
| 11 | 0.1 | 1 | 2 | 395 |
| 12 | 0.2 | 1 | 2 | 430 |
| 13 | 0.3 | 1 | 2 | 430 |
| 14 | 0.4 | 1 | 2 | 400 |
| 15 | 0.1 | 1 | 1.9 | 390 |
| 16 | 0.2 | 1 | 1.8 | 415 |
| 17 | 0.3 | 1 | 1.7 | 420 |
| 18 | 0.4 | 1 | 1.6 | 380 |
| Sachtoklar | | | | |
| 19 | 0.2 | 1 | 2 | 370 |
| 20 | 0.2 | 1 | 1.8 | 370 |
| Ekoflock | | | | |
| 21 | 0.2 | 1 | 1.8 | 385 |

From the results shown in the table it can be seen that a combination of 2 kg/t of the silica based colloid and 1 kg/t of the polyacrylamide gives 320 ml CSF. An increase in the system in the amount of polyacrylamide from 1 to 1.2 kg gives an increase of 10 ml. An increase of the colloid from 2 to 2.2 kg gives an increase of 20 ml. An addition of only 0.2 kg of the polyaluminum compound WAC to the system of 2 kg/t of colloid and 1 kg polyacrylamide gives a CSF increase of 110 ml (from 320 to 430), while an increase of the amount of polyacrylamide from 1 to 2 kg in the system of colloid and cationic retention agent only gives an increase of 35 ml (from 320 to 355), and here it can be mentioned also that the cationic polyacrylamide is about 10 times as expensive as the polyaluminum compound.

COMPARISON

Comparisons were made with the same stock as above, using the same conditions, the same anionic sol and the same method of evaluation, both with systems containing cationic starch instead of the cationic polyacrylamide and with such a system including addition of an anionic polyacrylamide of medium high anionicity (PAM⁻) as according to the U.S. Pat. No. 4,643,801, using the order of addition as disclosed in Example III in the patent. The polyaluminum compound was the above defined WAC. The results are shown in the Table below.

| Test No. | Polyaluminum compound kg/t | Cationic starch kg/t | PAM⁻ kg/t | Colloid kg/t | CSF ml |
|---|---|---|---|---|---|
| 1 | — | — | — | — | 110 |
| 2 | — | 8.2 | — | — | 240 |
| 3 | — | 8.2 | — | 0.36 | 245 |
| 4 | — | 8.2 | 0.9 | 0.36 | 145 |
| 5 | 0.2 | 8.2 | — | 0.36 | 260 |
| 6 | 0.2 | 8.2 | 0.9 | 0.36 | 260 |
| 7 | 0.2 | 11.3 | 1.36 | 0.20 | 235 |

The results clearly show the advantages of using the present method wherein the cationic retention agent is a cationic synthetic polymeric agent and in using this in combination with an anionic inorganic colloid and a polyaluminum compound for improving drainage in papermaking.

EXAMPLE 2

In this example the dewatering effect was evaluated in the same manner as in Example 1. The stock system was composed of a recycled fibres (Inland waste pulp) with a CSF of 138 ml and the pH of the stock was 6.5.

Two different kinds of anionic silica based colloids were used. Colloid (1) was a 15% alkali stabilized silica sol with a specific surface of about 500 $m^2/g$ (according to EP No. 0041056) from Eka Nobel AB. Colloid (2) was a colloidal bentonite with a specific surface in water of about 400 to 800 $m^2/g$. The polyaluminum compound was WAC as used in Example 1 and as cationic polymeric retention agents both the polyacrylamide, PAM, as in Example 1 and a polyethyleneimine, PEI, sold by BASF AG under the name of Polymin SK.

Also in these tests the collected water was very clear after the addition of the three components which shows that a good retention of the fibre flocks was obtained.

| Test No. | Polyaluminum compound kg/t | Cationic polymer kg/t | Colloid (No.) kg/t | CSF ml |
|---|---|---|---|---|
| | — | — | — | 138 |
| 1 | — | PAM 1 | — | 210 |
| 2 | — | 1 | (1) 2.0 | 260 |
| 3 | 0.2 | 1 | 1.8 | 300 |
| 4 | 0.4 | 1 | 1.6 | 320 |
| 5 | 1.0 | 1 | 1.0 | 300 |
| 6 | 0.2 | 1 | — | 260 |
| 7 | — | 1 | (2) 2.0 | 290 |
| 8 | 0.2 | 1 | 1.8 | 325 |
| 9 | 0.4 | 1 | 1.6 | 340 |
| 10 | 0.8 | 1 | 1.2 | 305 |
| 11 | 0.4 | 1 | 0.8 | 350 |
| 12 | — | PEI 0.75 | — | 150 |
| 13 | — | 0.75 | (2) 2.0 | 230 |
| 14 | 0.2 | 0.75 | 2.0 | 300 |
| 15 | 0.3 | 0.75 | 2.0 | 300 |

I claim:

1. A process for improving the retention of fines and optional fillers and for improving dewatering at the production of paper comprising the forming and dewatering of a suspension comprising papermaking fibers, on a wire, said forming and dewatering being carried out at a pH above 5 and in the presence of (a) an anionic inorganic colloid which is present in an amount of from 0.005 to 2 percent by weight based on dry fibers and optional fillers and which is selected from the group consisting of a silica sol, a silica sol with particles which have at least a surface layer of aluminum silicate and an aluminum modified silica sol, (b) a water-soluble, basic, polyaluminum compound which is present in an amount such that the weight ratio of the polyaluminum compound to the anionic inorganic colloid is from 0.01:1 to 3:1, and (c) a cationic, synthetic polymeric retention agent which is present in an amount of 0.01 to 3 percent by weight based on dry fibers and optional fibers and which comprises a cationic polyacrylamide or polyethyleneimine.

2. A process according to claim 1, wherein the colloidal sol particles have a size below 20 nm.

3. A process according to claim 1 or 2, wherein the polyaluminum compound is added to the suspension before the cationic retention agent and the anionic inorganic colloid.

4. A process according to claim 1 or 2, wherein the cationic retention agent comprises a cationic polyacrylamide.

5. A process according to claim, wherein the polyaluminum compound comprises a polyaluminum chloride or a polyaluminum chloride containing sulphate.

6. A process according to claim 1 or 2, wherein the polyaluminum compound has the net formula $n[Al_2(OH)_mCl_{6-m}]$ wherein n is $\geqq 4$ and which has a basicity of from 30 to 90%.

7. A process according to claim 1 or 2, wherein the polyaluminum compound, in aqueous solution, contains at least 4 aluminum atoms per ion.

8. A process according to claim 5, wherein the polyaluminum compound has the net formula $n[Al_2(OH)_mCl_{6-m}]$ wherein n is $>4$ and which has a basicity of from 30 to 90%.

9. A process according to claim 5, wherein the polyaluminum compound, in aqueous solution, contains at least 4 aluminum atoms per ion.

10. The process according to claims 1 or 2, wherein the suspension further comprises a filler.

* * * * *